US006213811B1

(12) United States Patent
Furusawa

(10) Patent No.: US 6,213,811 B1
(45) Date of Patent: Apr. 10, 2001

(54) IC CARD WITH SOCKET PROTECTING INTERNAL CIRCUIT AGAINST STATIC ELECTRICITY

(75) Inventor: Tetsuya Furusawa, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/262,877

(22) Filed: Mar. 8, 1999

(30) Foreign Application Priority Data

Mar. 12, 1998 (JP) ..... 10-060990

(51) Int. Cl.[7] ..... H01R 13/648

(52) U.S. Cl. ..... 439/607; 439/76.1; 439/946; 361/737

(58) Field of Search ..... 439/76.1, 75, 55, 439/607, 946; 361/737, 753, 816

(56) References Cited

U.S. PATENT DOCUMENTS 4,824,377 * 4/1989 De Burro ..... 439/186
5,288,247 * 2/1994 Kaufman ..... 439/607
5,338,215 * 8/1994 Lee et al. ..... 439/188
5,342,220 * 8/1994 Kodama ..... 439/607
5,399,105 * 3/1995 Kaufman et al. ..... 439/609
5,627,729 * 5/1997 Oldendorf et al. ..... 361/737
5,700,164 * 12/1997 Weidler et al. ..... 439/607
5,896,274 * 4/1999 Ishida ..... 361/737
6,007,381 * 12/1999 Ando et al. ..... 439/607

FOREIGN PATENT DOCUMENTS 6-29903 8/1994 (JP) ..... H01R/13/52

* cited by examiner

*Primary Examiner*—Khiem Nguyen
*Assistant Examiner*—Michael C. Zarroli
(74) *Attorney, Agent, or Firm*—Brinks Hoffer Gilson & Lione

(57) ABSTRACT

In an IC card with socket, a conductive member is attached to the front surface section of a socket housing into which the pin contacts of an IC card connector device (not shown) are inserted and electrically connected to a metal cover. With this arrangement, even if static electricity having a large amount of charge is charged to an operator, the static electricity is discharged to the conductive member and removed without discharging to socket contacts. Accordingly, the LSI in the IC card is not broken by the static electricity.

5 Claims, 4 Drawing Sheets

IC CARD WITH SOCKET PROTECTING INTERNAL CIRCUIT AGAINST STATIC ELECTRICITY

BACKGROUND OF THE INVENTION

1. Field of the Invention

The present invention relates to the improvement of an IC card with socket which is inserted into and extracted from an IC card connector device.

2. Description of the Related Art

There are conventionally available IC cards with socket having a large storage capacity. The IC card with socket includes an IC composed of an ultra-high dense circuit and disposed in it and a plurality of socket contacts mounted on a socket housing.

The IC card with socket will be described based on the side elevational view of FIG. 6 which shows the card with the main portion of it shown in a cross section. First, the IC card with socket 10 has a metal cover 11 formed to the exterior thereof and a socket housing 12 is mounted in the metal cover 11. Disposed to the socket housing 12 are a plurality of socket inserting holes 12*a* and a plurality of pin inserting holes 12*c* disposed in connection to the socket inserting holes 12*a*. The socket inserting holes 12*a* are located on the upper and lower sides of the socket housing 12 in two rows in a lateral direction and the pin inserting holes 12*c* are located on the front surface section 12*b* of the socket housing 12.

Socket contacts 13 are inserted into the socket inserting holes 12*a*. The socket contacts 13 have terminal sections 13*a* which extends therefrom rearward in two rows on upper and lower sides, and a substrate 14 is clamped between the terminal sections 13*a*. An IC circuit 14*a* composed of an LSI and the like having a large storage capacity are mounted on the substrate 14.

Further, the interior of the IC card with socket 10 is sealed by the metal cover 11 on the outside periphery thereof.

In the conventional IC card with socket 10 arranged as described above, even if a finger and the like of an operator to which static electricity is charged approach the front surface section 12*b* of the socket housing 12, since the static electricity is discharged to the metal cover 11 and removed, a failure caused by the static electricity to the IC circuit 14*a*, which is composed of the LSI and the like and mounted on the substrate 14, can be prevented.

For example, if an operator operating the IC card with socket 10 is wearing nylon clothing, friction from the nylon clothing may create a high voltage static electricity buildup present on the operator.

When a finger and the like of the operator to which the static electricity having the large amount of charge is charged approach the front surface section 12*b* of the socket housing 12, the static electricity may be discharged to the socket contacts 13 in the socket housing 12. Thus, there is a possibility that a failure such as electrostatic breakdown is caused to the IC circuit 14*a* by the discharge.

SUMMARY OF THE INVENTION

It is an object of the present invention to provide an IC card with socket capable of preventing the circuit within the IC card from being damaged by a high voltage static electricity discharge present on an operator operating the IC card.

An IC card with socket of the present invention as a first means for solving the above problem comprises a plurality of socket contacts connected to the pin contacts of an IC card connector device; a socket housing to which the socket contacts are attached in parallel with each other in a lateral direction in two rows on upper and lower sides; a metal cover for covering the socket housing; and a conductive member attached to the front surface section of the socket housing into which the pin contacts of the IC card connector device are inserted, wherein the conductive member is electrically connected to the metal cover to shut off static electricity from the outside.

As a second means for solving the above problem, it is preferable that the socket housing has pin inserting holes, into which the pin contacts of the IC card connector device are inserted, formed to the front surface section and the conductive member covers the entire front surface section of the socket housing except the pin inserting holes.

As a third means for solving the above problem, it is preferable that the conductive member is molded of a metal sheet, the socket housing is molded of a resin material and the conductive member is molded and attached to the socket housing integrally therewith.

Further, it is preferable that the conductive member is molded integrally with the metal cover which is bent along the front surface section of the socket housing.

DESCRIPTION OF THE PREFERRED EMBODIMENTS

The IC card with socket of the present invention will be described based on FIG. 1 to FIG. 4. First, the IC card with socket K of the present invention is formed to a substantially rectangular card and the outside periphery thereof is covered with a metal cover 1. A connector section la is formed to the front side of the metal cover 1 to mount a socket housing 2 to be described later in the metal cover 1.

A plurality of dimple-shaped projecting portions 1*b* are formed to the top surface of the connector section 1*a*. When the IC card with socket K is mounted on an IC card connector device (not shown), the projecting portions 1*b* come into contact with the shrouding plate of the IC card connector device (not shown) so that the metal cover 1 is electrically connected to the shrouding plate.

Figure 3A:
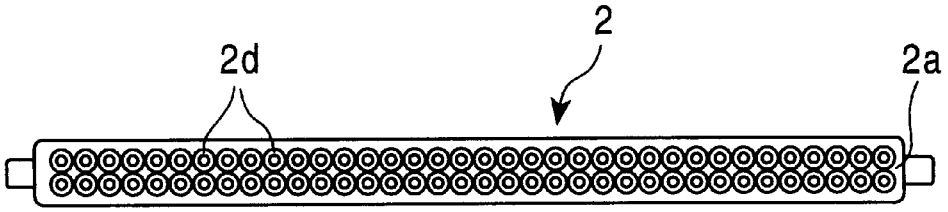
FIG. 3A, FIG. 3B and FIG. 3C are a top plan view, a front elevational view and a bottom plan view of the socket housing of the IC card with socket of the present invention.
Figure 3B:
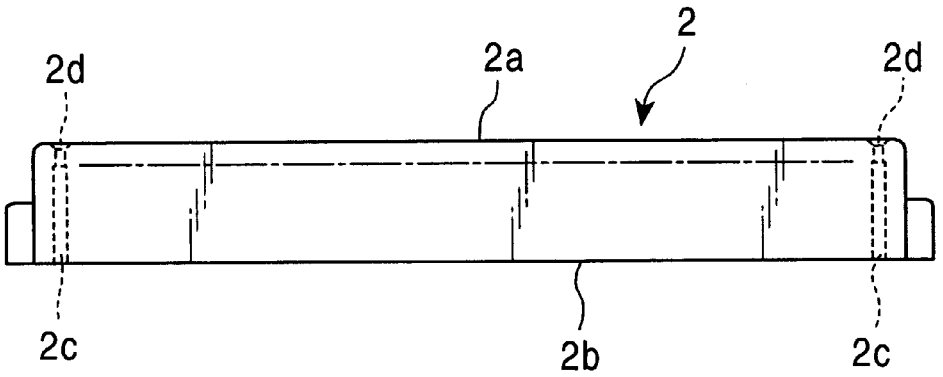
Figure 3C:
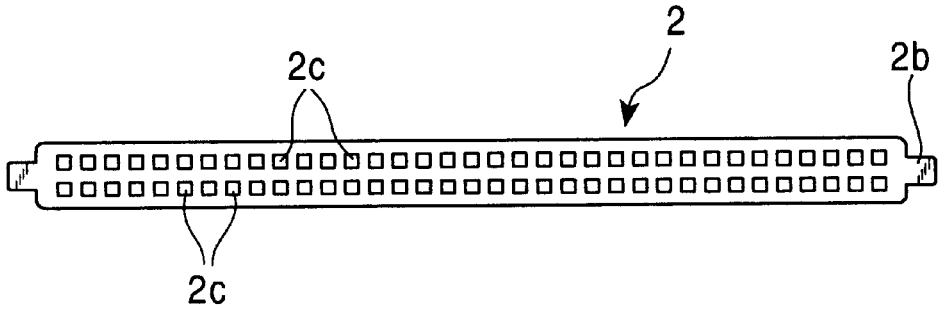

The socket housing 2, which is of a substantially rectangular outside shape and as shown in FIG. 3, is molded of a resin material or the like and disposed in the connector section la of the metal cover 1. The socket housing 2 is formed of a front surface section 2*a* and a rear surface section 2*b* .

A plurality of square-hole-shaped socket inserting holes 2*c*, each having a prescribed depth, are formed in parallel with each other to the rear surface section 2*b* in two rows on upper and lower sides in a lateral direction, whereas cone-shaped pin inserting holes 2*d*, into which the contact pins of the IC card connector device (not shown) are inserted, are formed to the front surface section 2*a* in connection to the socket inserting holes 2*c* .

A plurality of socket contacts 3 which are disposed in parallel with each other in the lateral direction in two rows on upper and lower sides are inserted into the square-hole-shaped socket inserting holes 2*c* and mounted on the socket housing 2.

In addition, the socket contacts 3 positioned in the socket insertion holes 2*c* are formed with a pair of contact sections 3*b* electrically connected while being contacted with each of the pin contacts (not shown) of the connector device for the IC card inserted into the socket housing 2.

The substrate 4 having circuit patterns 4*a* formed on both the surfaces thereof is clamped between the terminal sections 3*a* of the plurality of socket contacts 3 in the two rows on the upper and lower sides. The terminal sections 3*a* are connected to the circuit patterns 4*a* by soldering or the like.

An IC circuit 5 composed of an LSI and the like is connected to the circuit patterns 4*a* of the substrate 4 at a position located rearward apart from the portion of the substrate 4 where the terminal sections 3*a* are soldered to the circuit patterns 4*a*.

A conductive member 6 composed of a metal sheet or the like is attached to the front surface section 2*a* of the socket housing 2. Then, the conductive member 6 is electrically connected to the metal cover 1 through solder (not shown) or the like.

Figure 4:
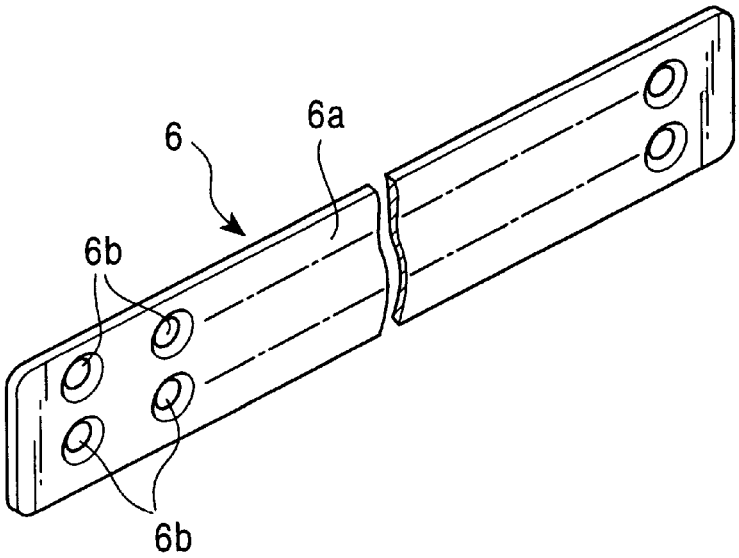
FIG. 4 is a perspective view of the conductive member of the IC card with socket of the present invention.

As shown in FIG. 4, the conductive member 6 is formed to a substantially rectangular shape, and pin inserting holes 6*b* as many as the pin inserting holes 2*d* of the socket housing are formed passing through the plane portion 6*a* of the conductive member 6 on one side in two rows on upper and lower sides.

Figure 2:
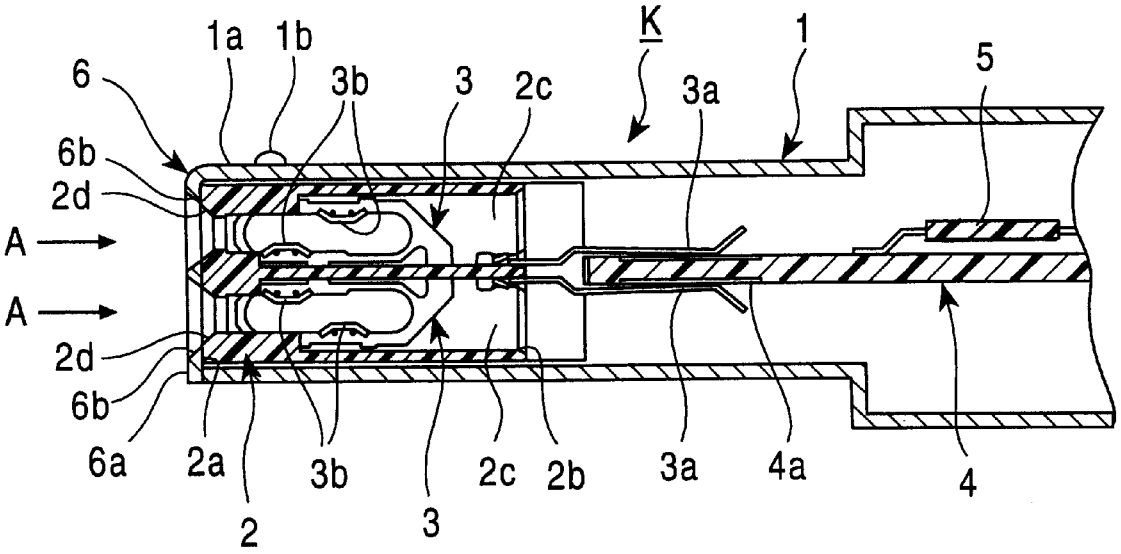
FIG. 2 is a side elevational view showing the IC card with socket with the main portion of it shown in a cross section.

The pin inserting holes 6*b* are formed to a conical-frustum-shape as shown in FIG. 2 and they have larger outside diameters on the sides thereof where the pin contacts of the IC card connector device are inserted thereinto in the direction of arrows A. That is, the conductive member 6 entirely covers the front surface section 2*a* of the socket housing 2 except the pin inserting holes 2*d*.

When the IC card with socket K arranged as described above is mounted on the IC card connector device (not shown), the pin contacts (not shown) are inserted from the direction of the arrows A up to the socket inserting holes 2*c* through the conductive member 6 and the pin inserting holes 6*b*, 2*d* of the socket housing 2 and electrically connected to the contact sections 3*b* of the socket contacts 3 in contact therewith.

The IC card with socket K of the present invention as described above will be schematically assembled by the following procedure. First, the plurality of the socket contacts 3 are inserted into the plurality of the socket inserting holes 2*c* formed to the rear surface section 2*b* of the socket housing 2 in the two tows on the upper and lower sides by an automatic machine or the like, respectively.

Thereafter, the substrate 4 is inserted between the plurality of terminal sections 3*a* in the two rows on the upper and lower sides which project from the rear surface section 2*b* of the socket housing 2. Then, the terminal sections 3*a* are aligned with the circuit patterns (not shown) formed on both the surfaces of the substrate 4 and soldered thereto.

In addition, the IC circuit 5 is previously soldered to the circuit pattern located rearward of the portion thereof where the terminal sections 3*a* are soldered.

Next, the conductive member 6 is soldered to the opening end surface at the connector section 1*a* of the metal cover 1. The socket housing 2 having the foresaid substrate 4 fixed thereto is inserted into the inner space of the connector section 1*a* until the socket housing 2 strikes against the conductive member 6. In this way, the socket housing 2 is held and positioned inside the connector section 1*a*.

the socket housing 2 positioned at the prescribed location is attached in the connector section la by an adhesive or the like and the opening (not shown) of the metal cover 1 on the rear side is closed by a not shown lid.

Next, the pin inserting holes 2*d* of the socket housing 2 attached in the connector section 1*a* are aligned with the pin inserting holes 6*b* of the conductive member 6 by a not shown alignment jig, and thereafter the conductive member 6 is electrically connected to the metal cover 1 by solder or the like, whereby the assembly of the IC card K of the present invention is finished.

According to the IC card with socket K of the present invention arranged as described above, even if a finger and the like of an operator to which static electricity having a large amount of charge is charged approach the front surface section 2*a* of the socket housing 2, the static electricity is discharged to the conductive member 6 and is not discharged to the socket contacts 3 in the socket housing 2.

Figure 1:
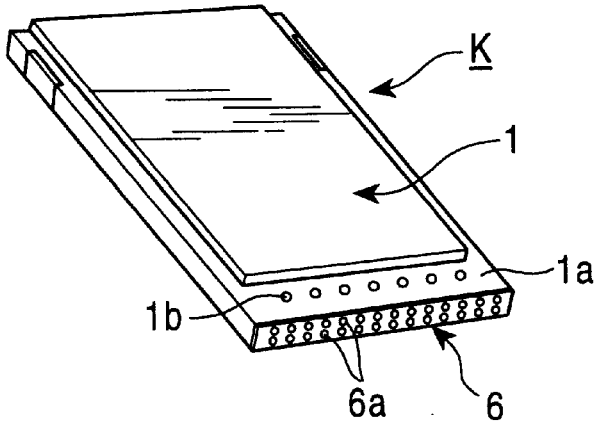
FIG. 1 is a perspective view of an IC card with socket of the present invention.

In the aforesaid preferred embodiment, the present invention has been described in reference to a device in which the conductive member 6 composed of a metal sheet is soldered to the metal cover 1 and fixed there. However, in another preferred embodiment of the present invention, it is preferable that when the socket housing 2 is formed by molding with resin, the aforesaid conductive member 6 is integrally molded at the outer surface of the socket housing 2 to form a shape such as one shown in FIG. 2 under application of a well-known molding process. Then, the integral product of the socket housing 2 and the conductive member 6 is assembled into the aforesaid metal cover 1 and the conductive member 6 integral with the socket housing 2 is soldered to the opening end surface at the connector section 1*a* of the metal cover 1 as shown in FIGS. 1 and 2.

Although it is described that the conductive member 6 covers the entire front surface section 2*a* of the socket housing 2 except the pin inserting holes 2*d*, it may cover a part of the front surface section 2*a* of the socket housing 2 (not shown).

Figure 5:
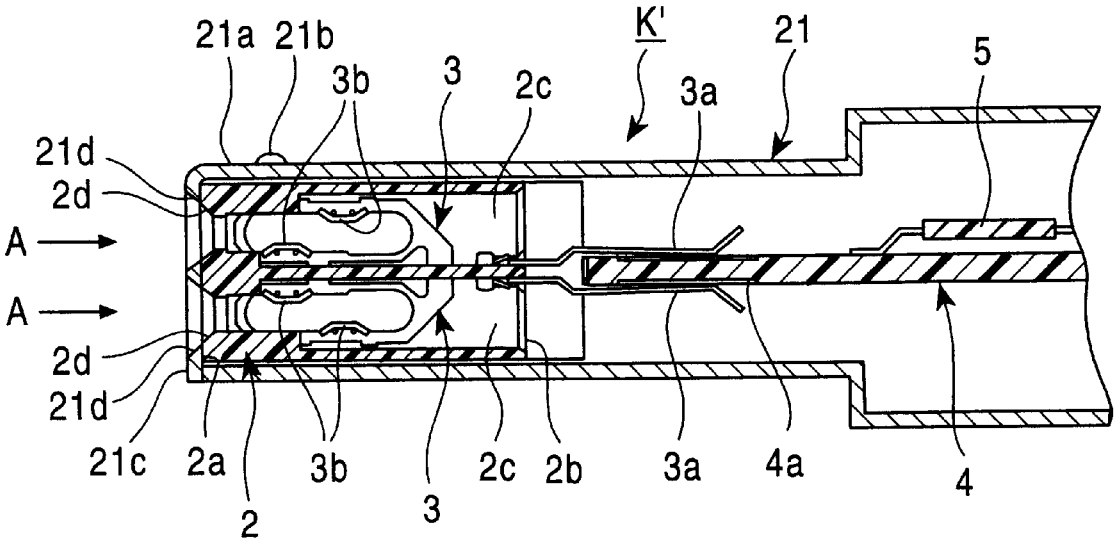
FIG. 5 is a side elevational view describing another embodiment of the IC card with socket of the present invention with the main portion of it shown in a cross section.
Figure 6:
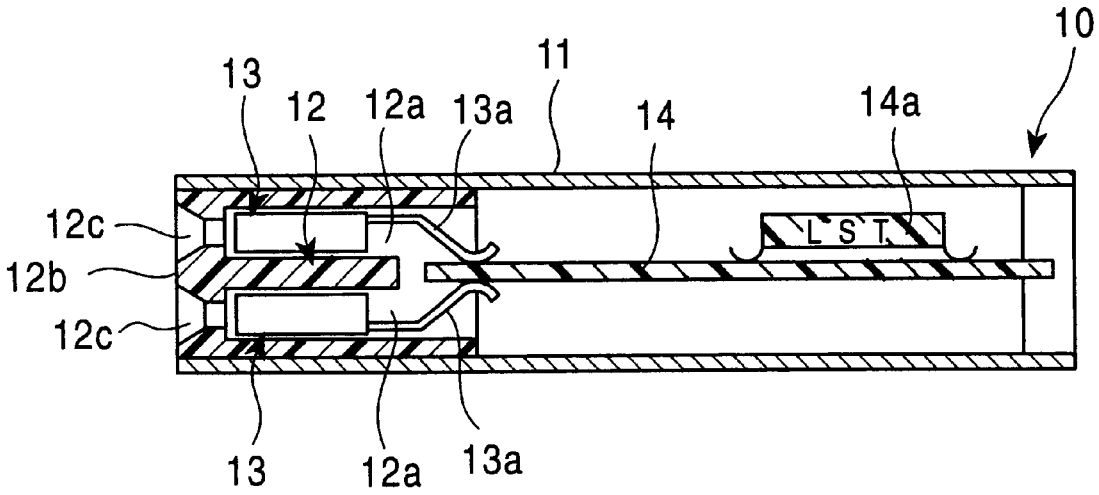
FIG. 6 PRIOR ART
FIG. 6 is a side elevational view of a conventional IC card with socket with the main portion of it shown in a cross section.

In the above description of the embodiment of the present invention, the conductive member 6 composed of the metal sheet is arranged independently of the metal cover 1. As shown in FIG. 5, however, a metal cover 21 may be arranged such that an extending section 21*c* is formed to a connector section 21*a* having dimple-shaped projecting portions 21*b* and bent downward so as to cover the front surface section 2*a* of the socket housing 2.

More specifically, the conductive member is molded integrally with the metal cover 21 which is bent along the front surface section 2*a* of the socket housing 2.

Further, although the conductive member 6 is composed of the metal sheet in the description of the embodiment of the present invention, a conductive film or the like may be formed on the front surface section 2*a* of the socket housing 2 by coating, for example, a conductive paint kneaded with metal powder on the front surface section 2*a* and the front surface section 2*a* of the socket housing 2 may be covered with the conductive film.

According to the IC card with socket of the present invention, since the conductive member is attached to the front surface section of the socket housing into which the pin contacts of the IC card connector device are inserted and electrically connected to the metal cover so as to shut off static electricity from the outside, even if a finger and the like of an operator to which static electricity having a large amount of charge is charged approach the front surface section of the socket housing, the static electricity is discharged to the conductive member and removed.

Since the socket housing has the pin inserting holes, into which the pin contacts of the IC card connector device are inserted, formed to the front surface section thereof and the conductive member covers the entire front surface section of the socket housing except the pin inserting holes, a failure to the IC circuit caused by static electricity can be more reliably prevented.

Since the conductive member is formed of the metal sheet, the socket housing is molded of the resin material, and the conductive member is molded and attached to the socket housing integrally therewith, a job for positioning the conductive member to the socket housing can be made unnecessary, whereby an IC card with socket which has a perfect countermeasure against static electricity and can be effectively assembled can be provided.

Further, since the conductive member is molded integrally with the metal cover which is bent along the front surface section of the socket housing, there can be provided an IC card with socket which has the smaller number of parts and can be assembled effectively.

What is claimed is:

1. An IC card with socket, comprising:

an electrically insulating socket housing having a plurality of socket contacts fixed thereto in which each of a plurality of pin contacts of an IC card connector device is inserted to make an electrical connection;

a metal cover to cover said socket housing; and a conductive member attached along a plane of said socket housing of a side into which the pin contacts of said IC card connector device are inserted, wherein said conductive member is electrically connected to said metal cover;

the plane of said socket housing where said pin contacts are inserted is provided with pin insertion holes to insert and guide each of the pin contacts; and said conductive member is provided with holes into which each of said pin contacts is inserted at a position corresponding to each of the pin insertion holes of said socket housing, each of said pin contact insertion holes of said conductive member having a conical trapezoid shape with a diameter gradually increasing from an inner side of said socket housing toward an outside.

2. An IC card with socket according to claim 1, wherein said conductive member is molded of a metal sheet, said socket housing is molded of a resin, said conductive member is integrally molded with resin together with said socket housing, and said conductive member is integrally fixed to said socket housing.

3. An IC card with socket according to claim 1, wherein said conductive member comprises a metal sheet.

4. An IC card with socket, comprising:

an electrical insulating socket housing having a plurality of socket contacts fixed thereto in which each of a plurality of pin contacts of an IC card connector device is inserted to make an electrical connection;

a metal cover to cover the socket housing; and a conductive member integrally attached to a plane of said socket housing of a side into which the pin contacts of said IC card connector device are inserted;

wherein the conductive member is electrically connected to said metal cover;

the plane of said socket housing where said pin contacts are inserted is provided with pin insertion holes to insert and guide each of the pin contacts; and said conductive member is provided with holes into which each of said pin contacts is inserted at a position corresponding to each of the pin insertion holes of said socket housing, each of said pin contact insertion holes of said conductive member having a conical trapezoid shape with a diameter gradually increasing from an inner side of said socket housing toward an outside.

5. An IC card with socket, comprising:

an electrical insulating socket housing having a plurality of socket contacts fixed thereto in which each of a plurality of pin contacts of an IC card connector device is inserted to make an electrical connection;

a metal cover to cover the socket housing; and a conductive member attached along a plane of said socket housing of a side into which the pin contacts of said IC card connector device are inserted;

wherein said metal cover and said conductive member are integrally formed from the same metal sheet;

the plane of said socket housing where said pin contacts are inserted is provided with pin insertion holes to insert and guide each of the pin contacts; and said conductive member is provided with holes into which each of said pin contacts is inserted at a position corresponding to each of the pin insertion holes of said socket housing, each of said pin contact insertion holes of said conductive member is of a conical trapezoid shape, and each of the pin contact insertion holes has a diameter gradually increased from an inner side of said socket housing toward an outside.

* * * * *

UNITED STATES PATENT AND TRADEMARK OFFICE

CERTIFICATE OF CORRECTION

PATENT NO. : 6,213,811 B1
DATED : April 10, 2001
INVENTOR(S) : Tetsuya Furusawa

It is certified that error appears in the above-identified patent and that said Letters Patent is hereby corrected as shown below:

Title page,
Item [74], delete "Hoffer" and substitute -- Hofer -- in its place.

Claim 2,
Line 1, delete "1" and substitute -- 4 -- in its place.

Signed and Sealed this

Sixteenth Day of April, 2002

*Attest:*

*Attesting Officer*

JAMES E. ROGAN
*Director of the United States Patent and Trademark Office*